US008439248B2

(12) United States Patent
Branchut

(10) Patent No.: US 8,439,248 B2
(45) Date of Patent: May 14, 2013

(54) METHODS AND ASSOCIATED APPARATUS OF CONSTRUCTING AND INSTALLING RIGID RISER STRUCTURES

(75) Inventor: Jean-Pierre Branchut, Houston, TX (US)

(73) Assignee: Subsea 7 (US) LLC, Houston, TX (US)

( * ) Notice: Subject to any disclaimer, the term of this patent is extended or adjusted under 35 U.S.C. 154(b) by 30 days.

(21) Appl. No.: 13/129,053

(22) PCT Filed: Nov. 11, 2009

(86) PCT No.: PCT/GB2009/051514

§ 371 (c)(1), (2), (4) Date: Jul. 19, 2011

(87) PCT Pub. No.: WO2010/055334

PCT Pub. Date: May 20, 2010

(65) Prior Publication Data

US 2011/0271508 A1 Nov. 10, 2011

Related U.S. Application Data

(60) Provisional application No. 61/114,160, filed on Nov. 13, 2008.

(30) Foreign Application Priority Data

Jan. 7, 2009 (GB) ..... 0900101.7

(51) Int. Cl.
*B23K 31/02* (2006.01)
*F16L 1/00* (2006.01)

(52) U.S. Cl.
USPC ..... 228/101; 405/170; 405/224.2

(58) Field of Classification Search ..... None
See application file for complete search history.

(56) References Cited

U.S. PATENT DOCUMENTS

| | | | | |
|---|---|---|---|---|
| 3,641,774 | A | 2/1972 | Hekkanen et al. | |
| RE30,590 | E * | 4/1981 | Blenkarn | 114/265 |
| 4,426,949 | A | 1/1984 | Knutsen | |
| 5,195,848 | A * | 3/1993 | Huete et al. | 405/202 |
| 5,197,825 | A * | 3/1993 | Rasmussen | 405/206 |
| 5,439,324 | A * | 8/1995 | Ekvall et al. | 405/202 |
| 6,082,391 | A * | 7/2000 | Thiebaud et al. | 137/236.1 |
| 6,257,801 | B1 * | 7/2001 | Kelm et al. | 405/224.2 |
| 6,321,844 | B1 * | 11/2001 | Thiebaud et al. | 166/345 |

(Continued)

FOREIGN PATENT DOCUMENTS

| | | |
|---|---|---|
| GB | 1375969 | 6/1995 |
| GB | 2426496 | 11/2006 |

(Continued)

*Primary Examiner* — Kiley Stoner
(74) *Attorney, Agent, or Firm* — Levy & Grandinetti

(57) ABSTRACT

Disclosed is a method of fabricating and installing a riser tower structure, preferably in a welding chamber, and a welding chamber suitable for the method. The method includes fabricating sections of the riser tower structure at a site remote from the site of installation; transporting the sections of the riser tower structure to within the vicinity of the installation site; and assembling together the sections of the riser tower structure in the vicinity of the installation site. The welding chamber includes a plurality of guide means, each providing a guide for one of the elongate elements of the riser tower structure, and floats on the sea surface when in use.

20 Claims, 11 Drawing Sheets

U.S. PATENT DOCUMENTS

| | | | | |
|---|---|---|---|---|
| 6,461,083 | B1 | 10/2002 | Pionetti et al. | |
| 8,136,599 | B2 * | 3/2012 | Alliot | 166/350 |
| 8,186,912 | B2 * | 5/2012 | Saint-Marcoux et al. | 405/224.2 |
| 8,231,308 | B2 * | 7/2012 | Alliot | 405/224.2 |
| 8,256,993 | B2 * | 9/2012 | Branchut et al. | 405/224.2 |
| 2004/0074648 | A1 * | 4/2004 | Legras et al. | 166/347 |
| 2004/0076478 | A1 * | 4/2004 | Legras et al. | 405/224.2 |
| 2004/0240947 | A1 * | 12/2004 | Wetch | 405/224.2 |
| 2004/0251029 | A1 * | 12/2004 | Horton, III | 166/345 |
| 2005/0063788 | A1 * | 3/2005 | Clausen | 405/224.2 |
| 2005/0092226 | A1 * | 5/2005 | Gehring | 114/264 |
| 2005/0232703 | A1 * | 10/2005 | Saint-Marcoux | 405/154.1 |
| 2006/0002767 | A1 * | 1/2006 | de Kerdanet | 405/224 |
| 2007/0003374 | A1 * | 1/2007 | Miorcec de Kerdanet et al. | 405/224 |
| 2008/0056829 | A1 * | 3/2008 | Horton et al. | 405/224 |
| 2008/0196899 | A1 * | 8/2008 | Alliot | 166/350 |
| 2008/0214072 | A1 * | 9/2008 | Saint-Marcoux | 441/5 |
| 2009/0226263 | A1 * | 9/2009 | Wetch | 405/224.4 |
| 2009/0297277 | A1 * | 12/2009 | Alliot | 405/224.2 |
| 2010/0018717 | A1 * | 1/2010 | Espinasse et al. | 166/346 |
| 2010/0172699 | A1 * | 7/2010 | Saint-Marcoux | 405/224.2 |
| 2011/0168399 | A1 * | 7/2011 | Saint-Marcoux et al. | 166/345 |
| 2011/0240308 | A1 * | 10/2011 | Legras | 166/367 |
| 2011/0253027 | A1 * | 10/2011 | Legras | 114/333 |
| 2011/0265701 | A1 * | 11/2011 | Murray et al. | 114/256 |
| 2011/0280667 | A1 * | 11/2011 | Branchut et al. | 405/224.2 |
| 2011/0315062 | A1 * | 12/2011 | Wetch | 114/265 |
| 2012/0090524 | A1 * | 4/2012 | Khachaturian | 114/265 |
| 2012/0207547 | A1 * | 8/2012 | Guzick et al. | 405/166 |
| 2012/0292039 | A1 * | 11/2012 | Saint-Marcoux et al. | 166/345 |

FOREIGN PATENT DOCUMENTS

| | | |
|---|---|---|
| WO | WO 95/17576 | 6/1995 |
| WO | WO 2005/103436 | 11/2005 |
| WO | WO 2006/136960 | 12/2006 |

* cited by examiner

METHODS AND ASSOCIATED APPARATUS OF CONSTRUCTING AND INSTALLING RIGID RISER STRUCTURES

This application is the U.S. National Phase of International Number PCT/GB2009/051514 filed on Nov. 11, 2009, which claims priority to Great Britain Application Number 0900101.7 filed on Jan. 7, 2009, and U.S. Provisional Application No. 61/114,160 filed on Nov. 13, 2008.

This invention is in the general field of riser fabrication and installation, and in particular, fabrication and installation of Hybrid Riser Tower structures.

Hybrid Riser Towers are known and form part of the so-called hybrid riser, having an upper portions ("jumpers") made of flexible conduit and suitable for deep and ultra-deep water field development. U.S. Pat. No. 6,082,391 (Stolt/Doris) proposes a particular Hybrid Riser Tower (HRT) consisting of an empty central core, supporting a bundle of (usually rigid) riser pipes, some used for oil production some used for injection of water, gas and/or other fluids, some others for oil and gas export. This type of tower has been developed and deployed for example in the Girassol field off Angola. Further background has been published in paper "Hybrid Riser Tower: from Functional Specification to Cost per Unit Length" by J F Saint-Marcoux and M Rochereau, DOT XIII Rio de Janeiro, 18 Oct. 2001. Updated versions of such risers have been proposed in WO 02/053869 A1. The contents of all these documents are incorporated herein by reference, as background to the present disclosure.

At present, Hybrid Riser Tower structures need to be fabricated close to the installation site, as the towing of an assembled Hybrid Riser Tower over significant distances carries with it many risks. In particular the surface waves and currents may result in significant fatigue and damage to the structure. Also, the simple act of transporting such a large structure proposes great logistical difficulties.

As a result of this, it is necessary to have a fabrication yard close to the installation site. Furthermore, the fabrication yard also requires a site having a long sheltered body of water directly in line with it, so that the Hybrid Riser Tower structure can be progressively fabricated and assembled. Such a suitable location is generally difficult to find.

It is an aim of the present invention to address the above mentioned issues.

In a first aspect of the invention there is provided a method of fabricating and installing a riser tower structure of the type comprising a plurality of elongate elements extending from the sea bed to a point at, or relatively near to, the sea surface, said method comprising:

- fabricating sections of said riser tower structure at a site remote from the site of installation;
- transporting the sections of said riser tower structure to within the vicinity of the installation site; and
- assembling together the sections of said riser tower structure in the vicinity of said installation site.

Preferably, the sections of said riser tower structure are assembled together in a welding chamber, or cofferdam. Said welding chamber may provide a dry welding area. Said welding chamber may be provided with a plurality of guide means, each providing a guide for one of the elongate elements of the riser tower structure. Preferably there are two groups of such guide means, provided on opposite sides of said welding chamber, such that when two sections of riser tower structure that are to be welded together are each introduced into the welding chamber via one of the groups of guide means, the corresponding elongate elements of each section are substantially aligned for welding. Preferably, each of said guide means provides a watertight opening into said welding chamber when said elongate element is in place. The groups of guide means may be replaceable and specifically chosen to correspond with the riser tower structure's cross sectional dimensions. Each of said groups of guide means may be provided on a door of said welding chamber.

Said assembly of sections of riser tower structure may be undertaken with said welding chamber floating on the sea surface. Ballasting tanks may be provided to selectively ballast the welding chamber accordingly.

An alignment frame may be used for fine alignment of the two sections to be connected. Said welding chamber may be open at the top, to allow access of said alignment frame.

Said riser tower structure, and each section thereof, may comprise a plurality of elongate conduits arranged around a central core. Said structure may also comprise other elongate elements, such as umbilicals. Said riser tower structure may be of the type designed to be held substantially vertical, as a result of a buoyancy force applied to its top, while its bottom is anchored to the sea bed. It may be designed so as to form part of a hybrid riser tower structure.

Said fabrication step may comprise the provision of at least one guiding frame on each section of riser structure, and the assembly step may comprise the attachment of said guiding frame to holding means provided on the welding chamber so as to hold the riser structure such that each elongate element is in alignment with its corresponding guiding means.

Fabrication of each section of riser tower structure may be performed in any fabrication yard, floating dock or dry dock at any suitable site, which may be very remote from the installation site. Said riser tower structure sections may then be transported by sea on any suitable vessel including heavy lift vessel, a cargo barge or a semi submersible heavy transport vessel.

Each section of riser tower structure may be greater than 100 meters long, and may lie between 100 meters and 300 meters in length. In a main embodiment they will be between approximately 150 and 200 meters.

A second welding chamber may be used to increase the assembly speed.

In a further aspect of the invention there is provided a marine welding chamber specifically adapted for the assembling together of sections of a riser tower structure of the type comprising a plurality of elongate elements extending from the sea bed to a point at, or relatively near to, the sea surface, wherein said welding chamber comprises a plurality of guide means, each providing a guide for one of the elongate elements of the riser tower structure, the welding chamber being designed to float on the sea surface, when in use.

Said welding chamber preferably provides a dry welding area.

Preferably there are two groups of said guide means, provided on opposite sides of said welding chamber. Preferably, said two groups of guide means are located directly opposite each other and are similarly aligned such that, when two sections of riser tower structure are introduced into said welding chamber, each via one of said groups of guide means, they are substantially aligned for welding. Preferably, each of said guide means provides a watertight opening into said welding chamber when said elongate element is in place. Each of said groups of guide means may be provided on a door of said welding chamber. Said groups of guide means may be comprised in removable and replaceable inserts specific to a particular riser tower structure's cross sectional dimensions.

Said welding chamber may comprise ballasting tanks for selectively ballasting the welding chamber.

Said welding chamber may be substantially open, or have an opening, at its top.

BRIEF DESCRIPTION OF THE DRAWINGS

Embodiments of the invention will now be described, by way of example only, by reference to the accompanying drawings, in which.

DETAILED DESCRIPTION OF THE EMBODIMENTS

Figure 1:
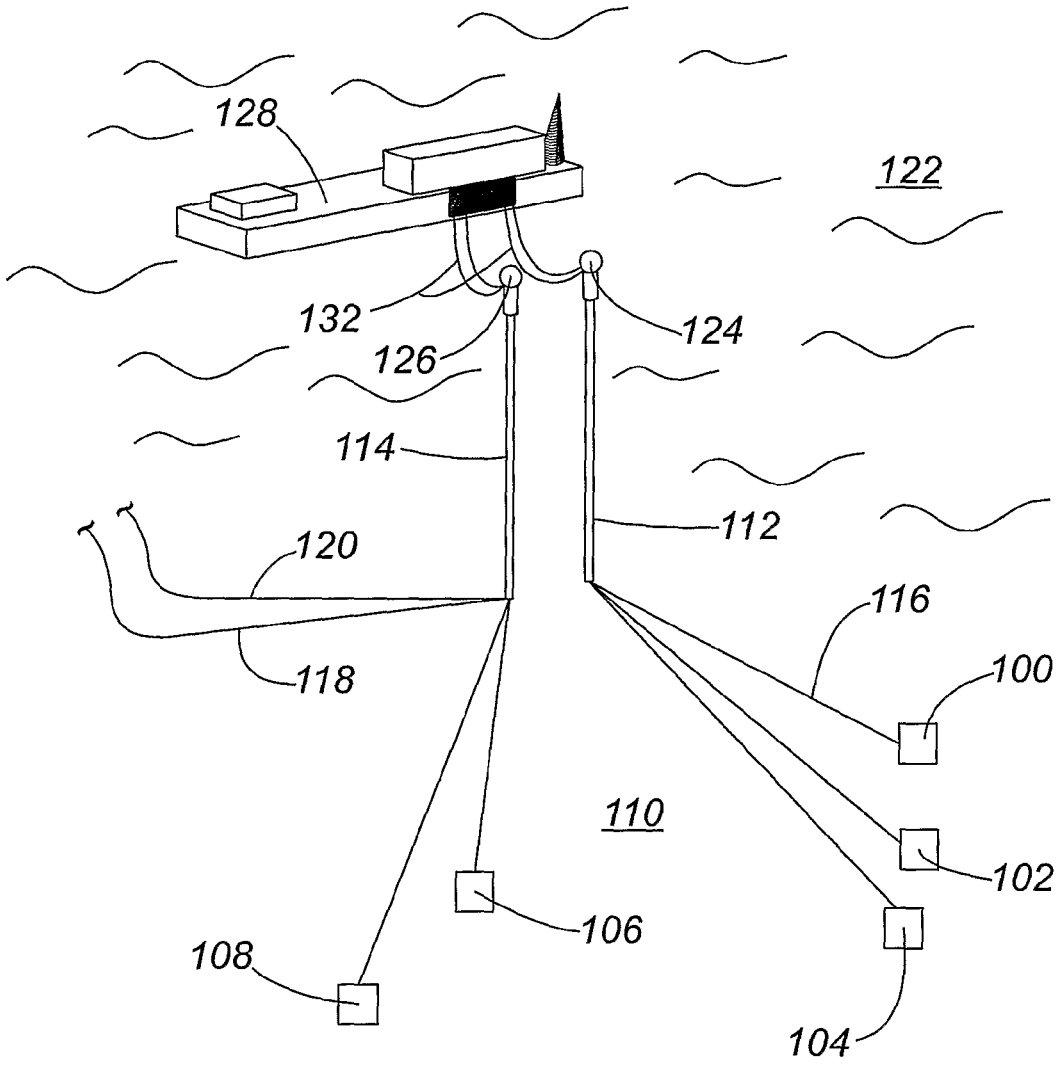
FIG. 1 shows a known type of hybrid riser structure in an offshore oil production system.

Referring to FIG. 1, the person skilled in the art will recognize a cut-away view of a seabed installation comprising a number of well heads, manifolds and other pipeline equipment 100 to 108. These are located in an oil field on the seabed 110. Vertical riser towers are provided at 112 and 114, for conveying production fluids to the surface, and for conveying lifting gas, injection water and treatment chemicals such as methanol from the surface to the seabed. The foot of each riser, 112, 114, is connected to a number of well heads/injection sites 100 to 108 by horizontal pipelines 116 etc.

Further pipelines 118, 120 may link to other well sites at a remote part of the seabed. At the sea surface 122, the top of each riser tower is supported by a buoy 124, 126. These towers are pre-fabricated at shore facilities, towed to their operating location and then installed to the seabed with anchors at the bottom and buoyancy at the top.

A floating production unit (FPU) 128 is moored by means not shown, or otherwise held in place at the surface. FPU 128 provides production facilities, storage and accommodation for the fluids from and to the wells 100 to 108. FPU 128 is connected to the risers by flexible flow lines 132 etc. arranged in a catenary configuration, for the transfer of fluids between the FPU and the seabed, via riser towers 112 and 114.

Individual pipelines may be required not only for hydrocarbons produced from the seabed wells, but also for various auxiliary fluids, which assist in the production and/or maintenance of the seabed installation. For the sake of convenience, a number of pipelines carrying either the same or a number of different types of fluid are grouped in "bundles", and the riser towers 112, and 114 in this embodiment comprise each one a bundle of conduits for production fluids, lifting gas, water and gas injection, oil and gas export, and treatment chemicals, e.g. methanol. All the component conduits of each bundle are arranged around a central core, and are held in place relative to each other (in the two lateral dimensions, longitudinal movement not being prevented) by guide frames attached to the central core.

Individual sections of riser tower structures, or bundles are fabricated such that individual sections of pipe, umbilicals, etc. are made and arranged around similar length sections of central core, the pipes and umbilicals being held in place around the core by one or more guide frames. As such, each bundle section is simply a short version of the whole riser structure, having the same cross section, such that the whole riser tower structure can be assembled by assembling together similar bundle sections, end on end (The top and bottom bundle sections will differ slightly in that they will have provisions for attachment to a top buoyancy module or anchor, as appropriate). This assembly is conventionally done as each section is fabricated, each section then being attached to the main riser tower structure extending out from the fabrication yard towards the nearby installation site.

Unlike conventional methods, the method describes herein separates the fabrication step and section assembly step. This allows the fabrication to take place anywhere in the world, remote from the installation site. The actual fabrication of each section differs little from present and therefore no further description of this step is necessary. However, instead of assembling together each section as it is fabricated, each section is simply stored until ready to be transported to the installation site. Eventually, the fabricated bundle sections are transported by any suitable heavy cargo vessel to the installation site.

It is at, or near, the installation site, that the individual bundle sections are assembled together to make the complete riser tower structure. In order to do this, a floating welding chamber, or cofferdam, is provided to connect together each section.

Figure 2:
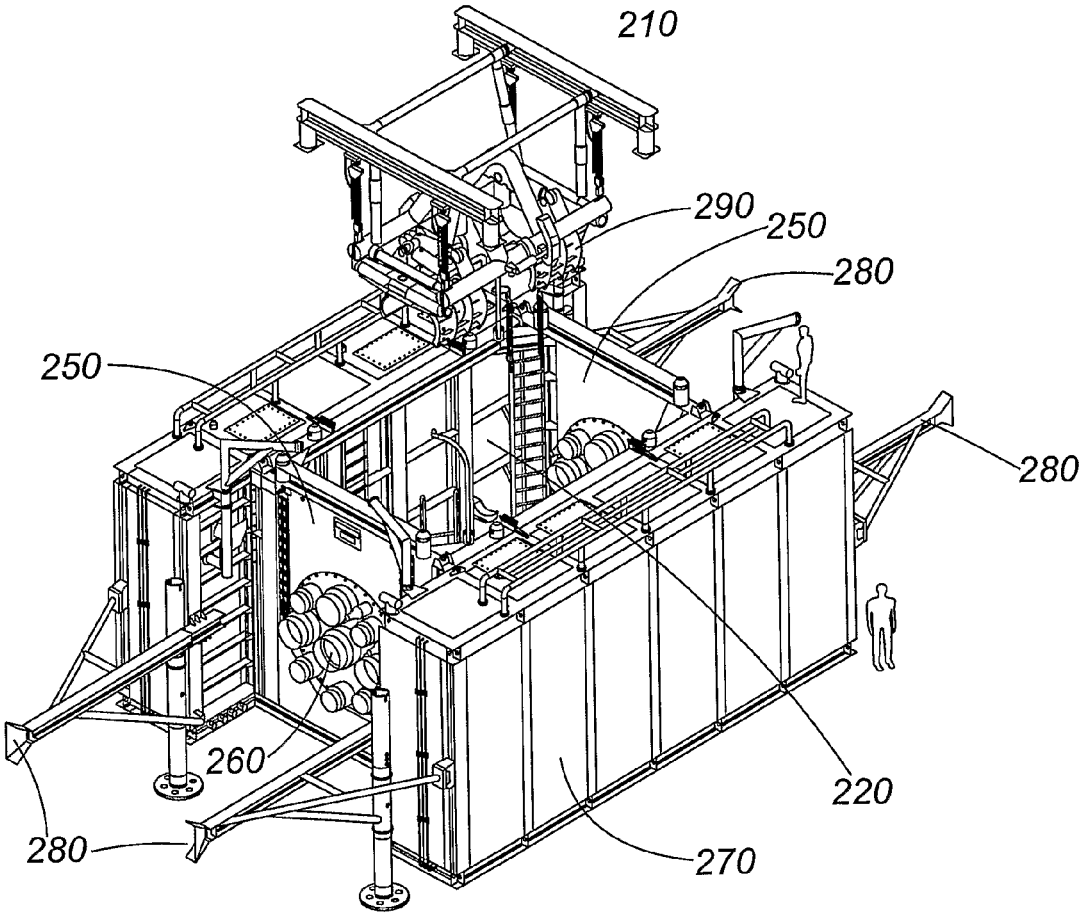
FIG. 2 shows a cofferdam arrangement, with associated alignment apparatus used in a method according to an embodiment of the invention.
Figure 3:
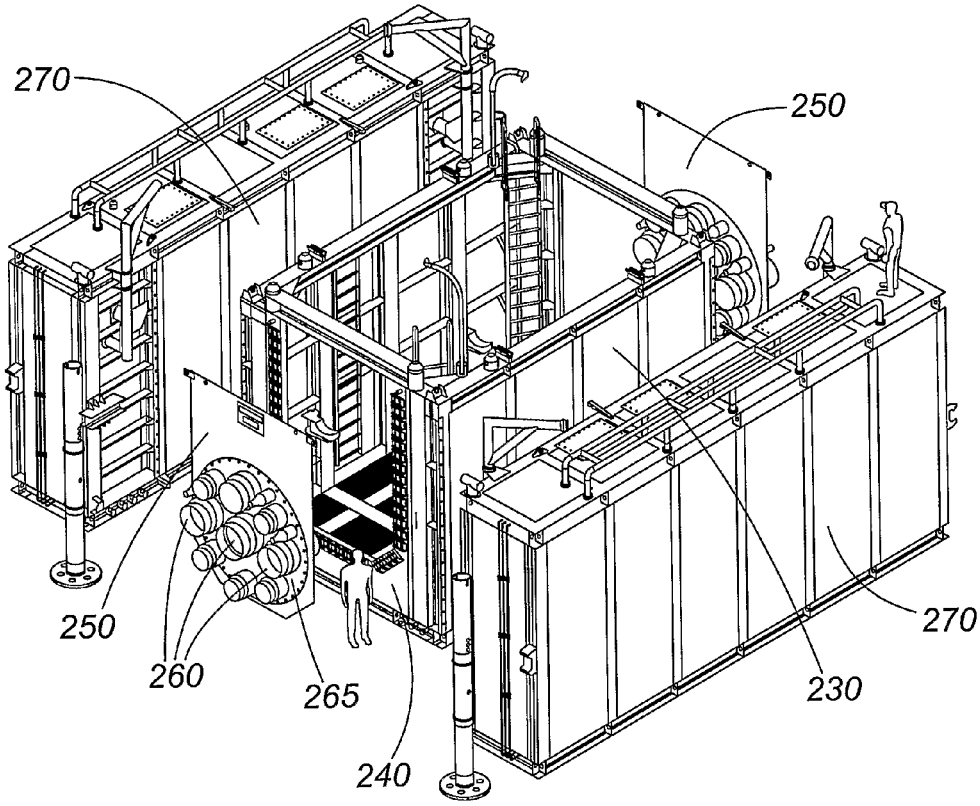
FIG. 3 is an exploded view of the cofferdam arrangement of FIG. 2.

FIG. 2 shows the cofferdam 200 with its alignment frame 210. FIG. 3 shows an exploded view of the same cofferdam 200, without the alignment frame 210. The cofferdam comprises a chamber 220 formed from walls 230 floor 240 and doors 250. Each door 250, has a plurality of openings 260 each opening 260 providing an entry into the cofferdam 200 for of the ends of the elongate elements (pipe, umbilical and central core) that make up each section of the riser tower structure. Ballast tanks 270 are also provided to selectively ballast the cofferdam as required. The openings 260 are grouped on a hub inset 265 in such a way as to match the cross sectional profile of the riser bundle sections. Accordingly these hub insets 265 are removable and replaceable, and will be manufactured for specific bundle designs.

Also shown (on FIG. 1) are holding means 280 for holding the guide frames which form part of each bundle section, when the pipes etc. are introduced into the cofferdam; and an alignment frame 210 which include claws 290 for gripping the core pipe of the two sections and precisely aligning them together for welding.

As the chamber 220 is designed to float on the sea surface the top of the chamber can remain open. Therefore it can be seen that the alignment frame 210 can be lowered into the chamber from above, as required, as can any other tool.

Figure 4:
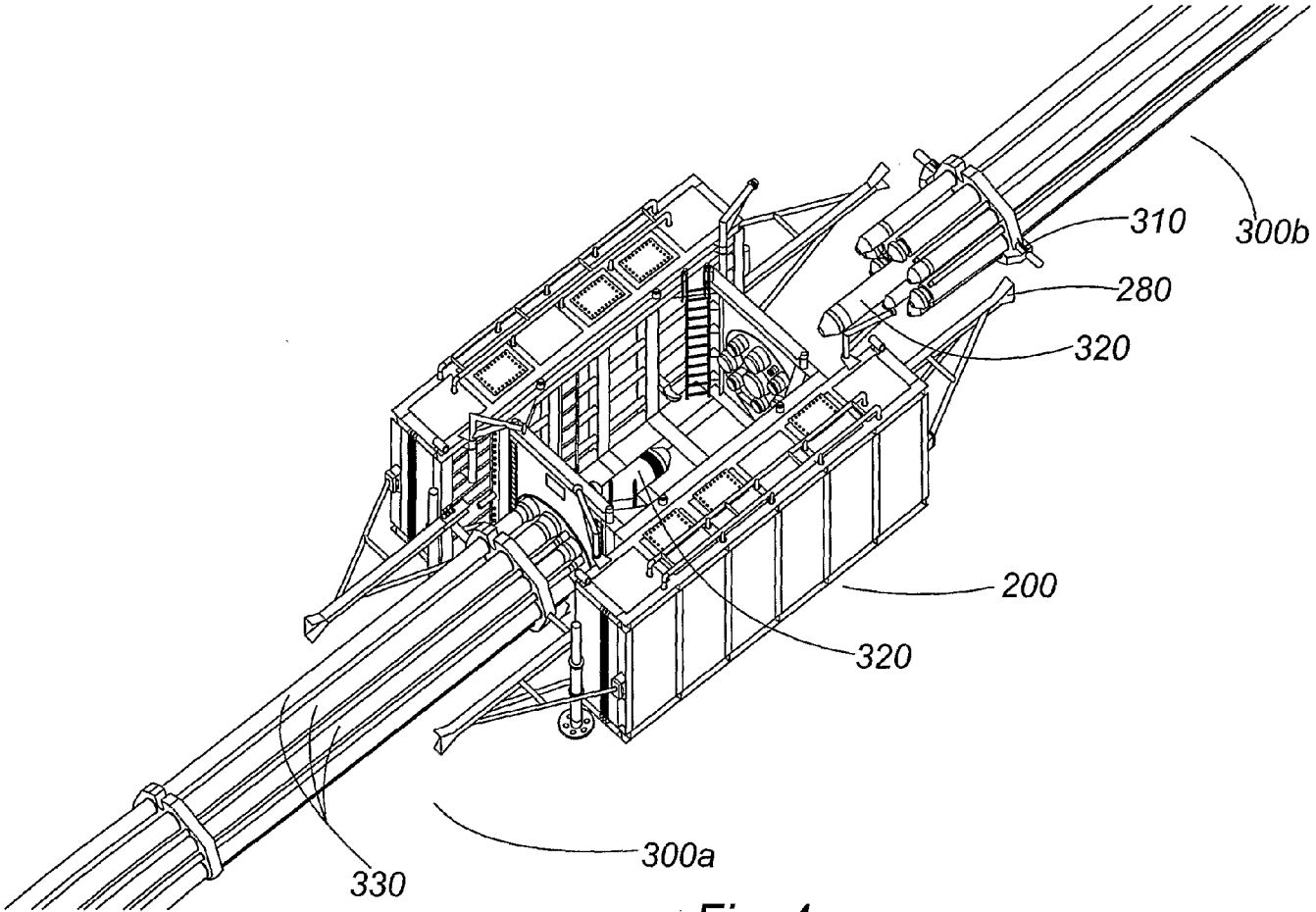
FIG. 4 shows a step of a method according to an embodiment of the invention, whereby riser structure sections are being introduced to the cofferdam.

FIG. 4 shows the cofferdam 200 from above, with one of the sections of the riser tower 300*a* being introduced into the welding chamber 220. As you can see the holding means 280 interacts with one of the guide frames 310 of the riser tower structure so as to hold the section 300*a* into position for introduction into the chamber 220. The guide frame is then able to slide along the holding means 280, along the core pipe's axis, as the core pipe 320 and then the other individual pipes/umbilicals 330, are introduced through the openings 260.

Also shown is another section of the riser tower structure, 300*b*, being lined up such that its guide frame 310 will be held by the holding means 280 on the other side of the chamber 200.

Figure 5A:
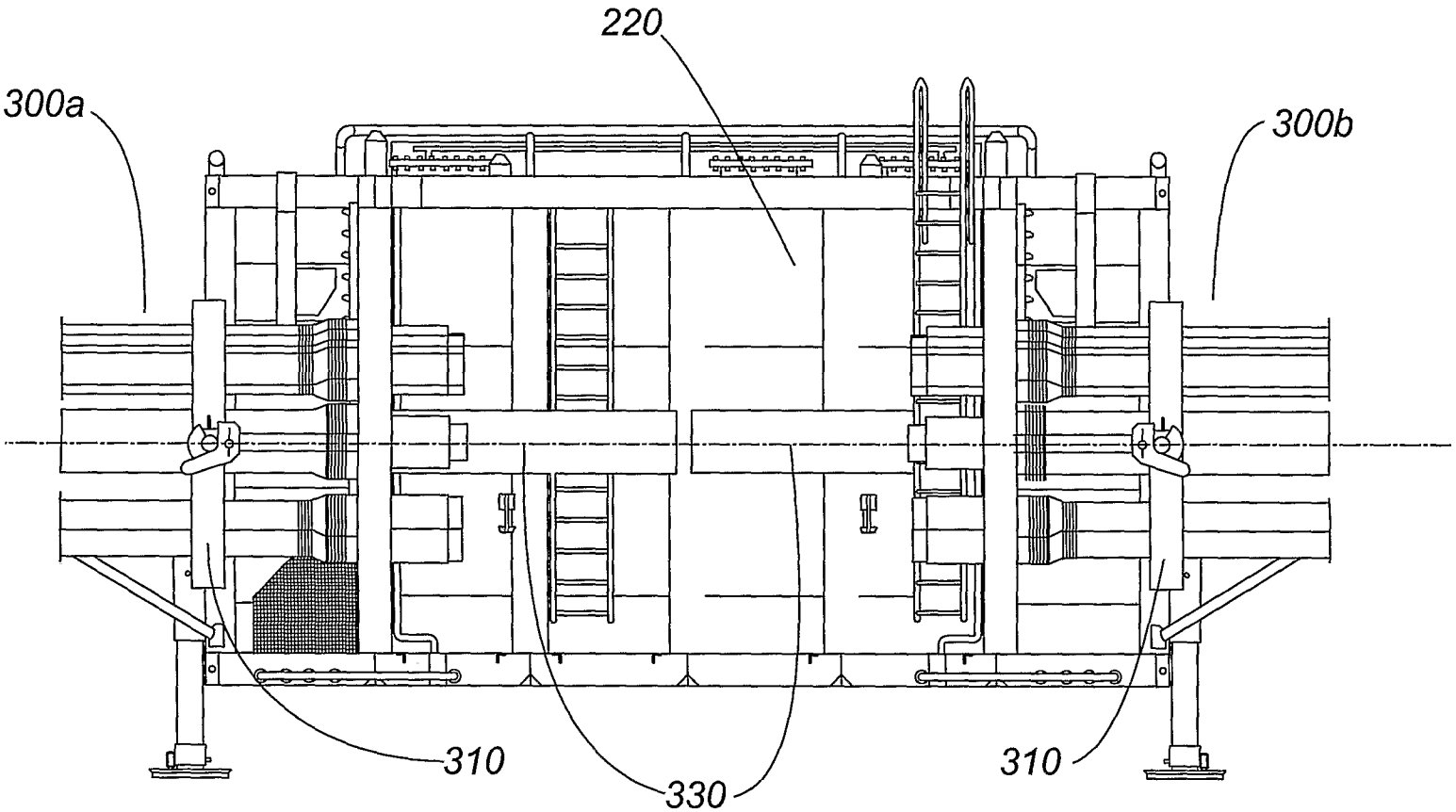
FIGS. 5*a* and 5*b* show the situation where both riser structure sections to be welded together are substantially in place for welding to begin.
Figure 5B:
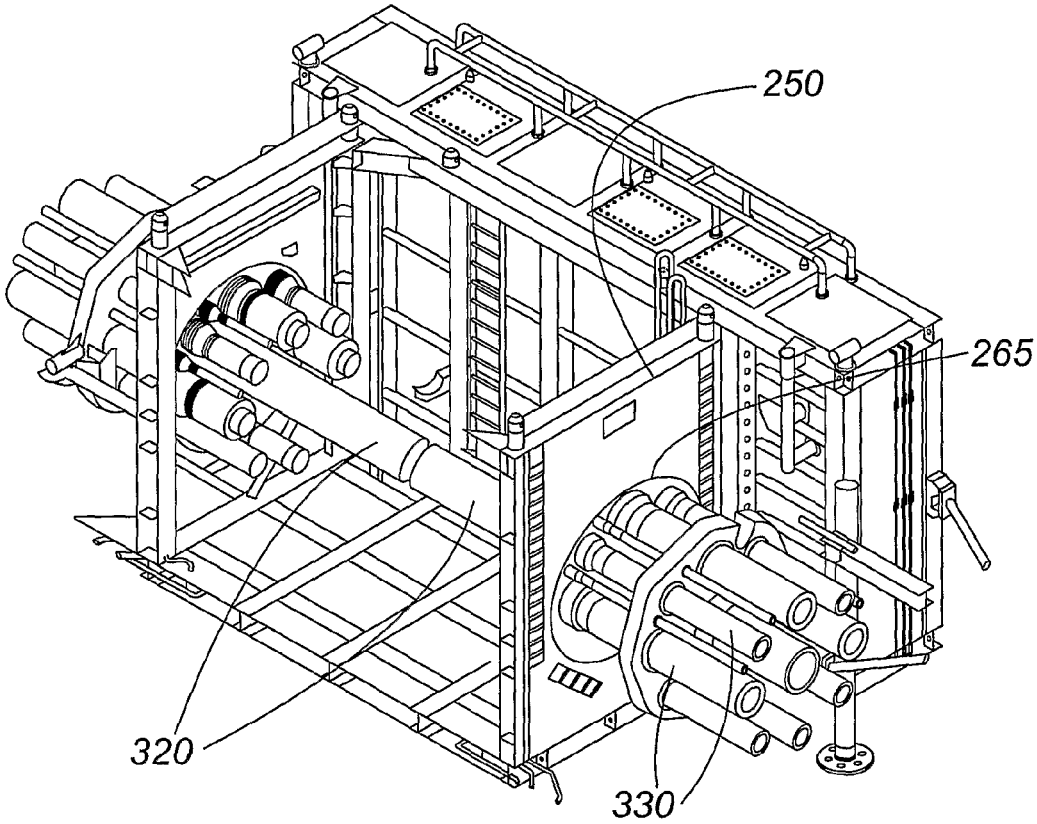

FIGS. 5*a* and 5*b* show the two riser tower sections 300*a*, 300*b* having both been introduced into the welding chamber 220. The seals around each individual pipe 330 and core 320 etc. have been made watertight and the welding area 220 has been de-watered. The alignment means 210 (as shown in FIG. 1) is now used to precisely align the two core pipes 320 after which they are welded together. After this, each individual pipe and umbilical 330 of one section is brought into contact with the corresponding pipe and umbilical 330 in the other section and are also welded together.

In this way, it is possible to assemble the sections of pipeline at the installation site, even where each section has been fabricated elsewhere, such as in the most cost-effective place.

The floating welding chamber or cofferdam allows safe and secure access to the welding site, in which welding can be performed in dry conditions and with the use of a hydraulic-powered alignment frame for fine alignment. After welding, a suitable joint coating can be applied to the joint in the chamber.

The welding chamber also permits the connection of risers of any diameter, as hub inserts 265 for the doors can be manufactured for any particular riser tower arrangement.

FIGS. 6*a*-6*e* show, in five steps, an embodiment of the fabrication and installation method.

Figure 6A:
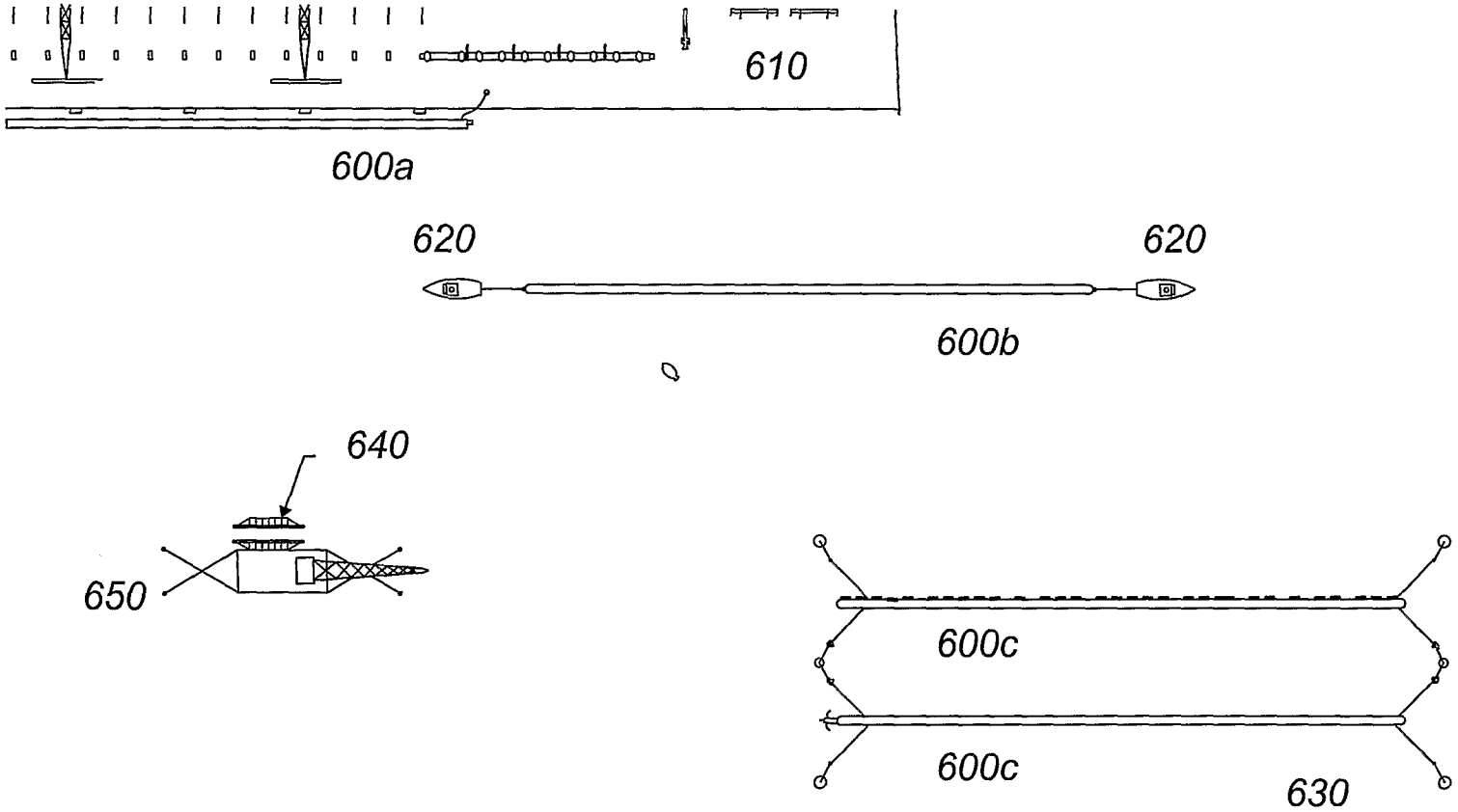
FIGS. 6*a*-6*e* show, in five steps, the fabrication and installation method according to an embodiment of the invention.

FIG. 6*a* shows a completed bundle section 600*a* moored at the bundle fabrication area 610, a further completed bundle section 600*b* being towed to the storage area 630 by tugs 620, and two more completed bundle sections 600*c* moored in the bundle section storage area 630. The cofferdam 640 is also shown, moored alongside construction barge 650. Construction barge 650 will contain much of the lifting, welding and coating equipment including crane, air supply, pup-piece preparation and lighting.

While this example shows the bundle section fabrication area 610 relatively local to the bundle installation site, with each individual bundle being towed to the bundle section storage area 630 when completed, the invention equally allows the fabrication area to be very remote from the installation site, in which case the bundle sections may be transported all together when completed, on a heavy barge or other suitable vessel.

Figure 6B:
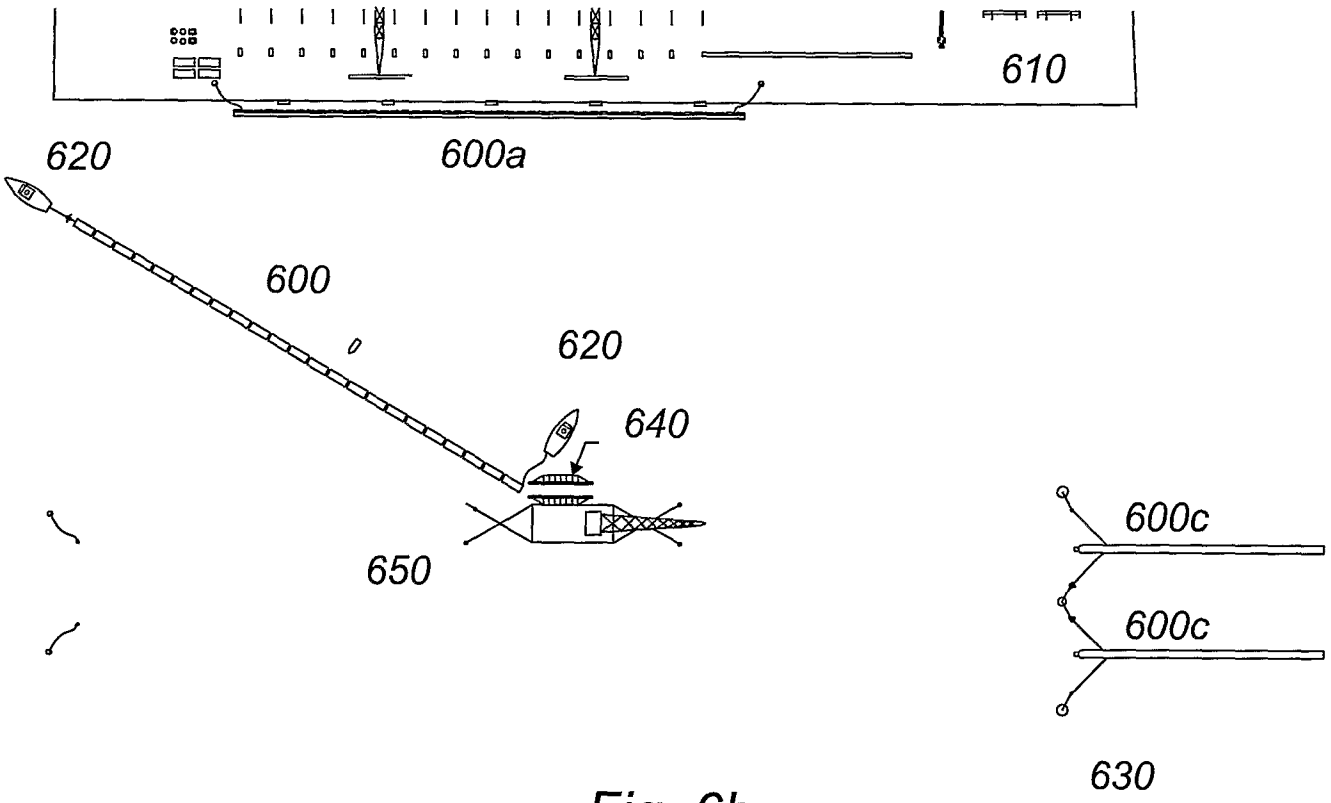

FIG. 6*b* shows the first of said bundle sections 600 being maneuvered into position by tugs 620. The bundle extremity will then be transferred to the cofferdam winches, and then the guide frame will be docked into the cofferdam guide structure (holding means 280 in FIGS. 2-5 above). The bundle section 600 can then be moored into place, and then be introduced inside the cofferdam 640.

Figure 6C:
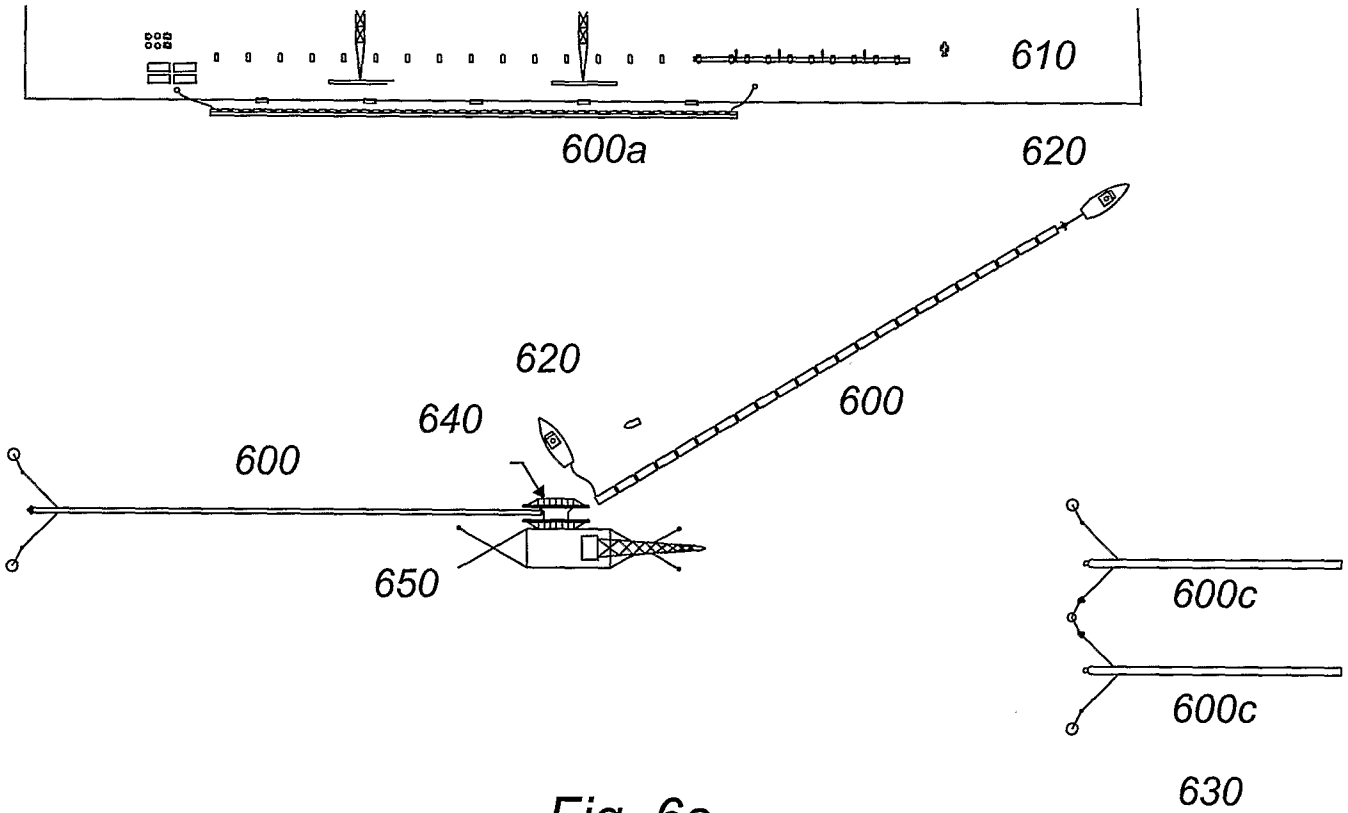

FIG. 6*c* shows the next bundle 600 being maneuvered into position by tug 620 so as to be joined to the first section. The mooring procedure is exactly the same as in the previous paragraph. Once this is also introduced into the cofferdam, the welding and tie-in process can begin.

Figure 6D:
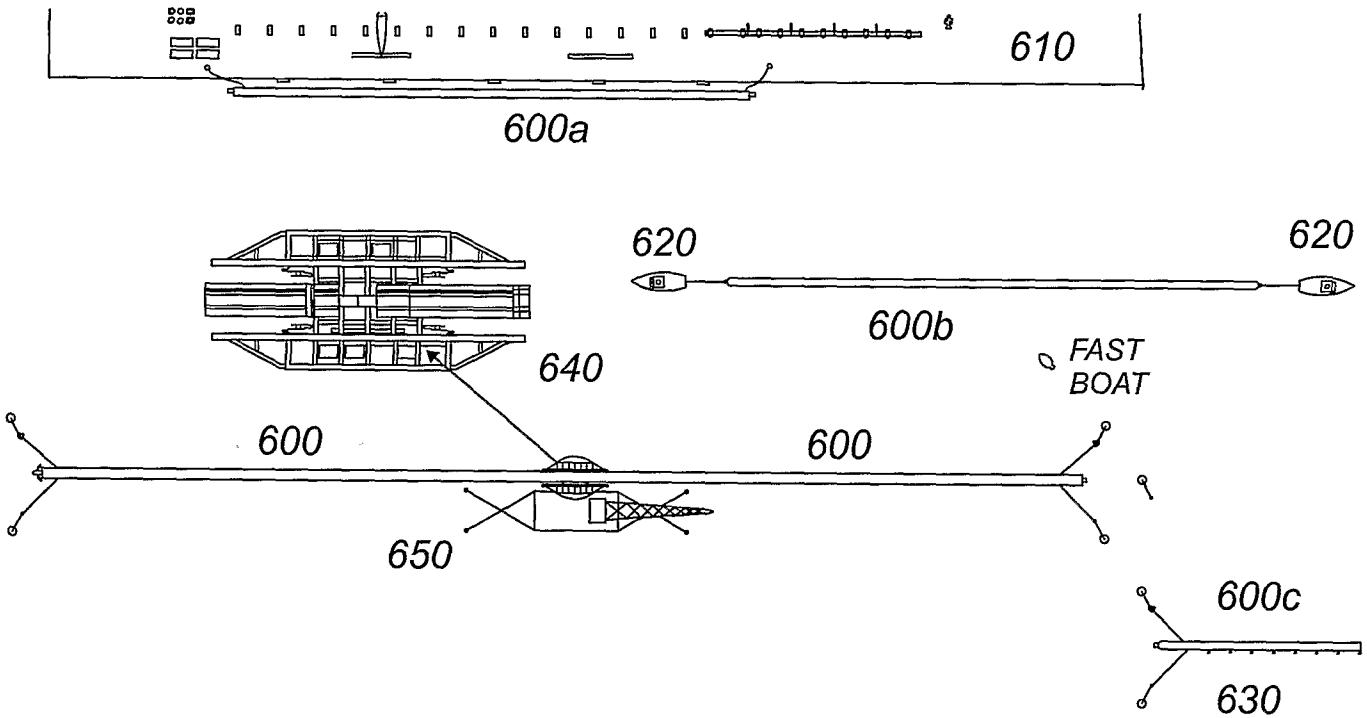

FIG. 6*d* shows the situation with the bundles sections 600 in place ready for welding together. The core pipes of the two sections are first brought together and connected, before the rest of the riser conduits are brought together and joined. The steps shown in FIGS. 6*c* and 6*d* can then be repeated for all the remaining bundle sections 600.

Figure 6E:
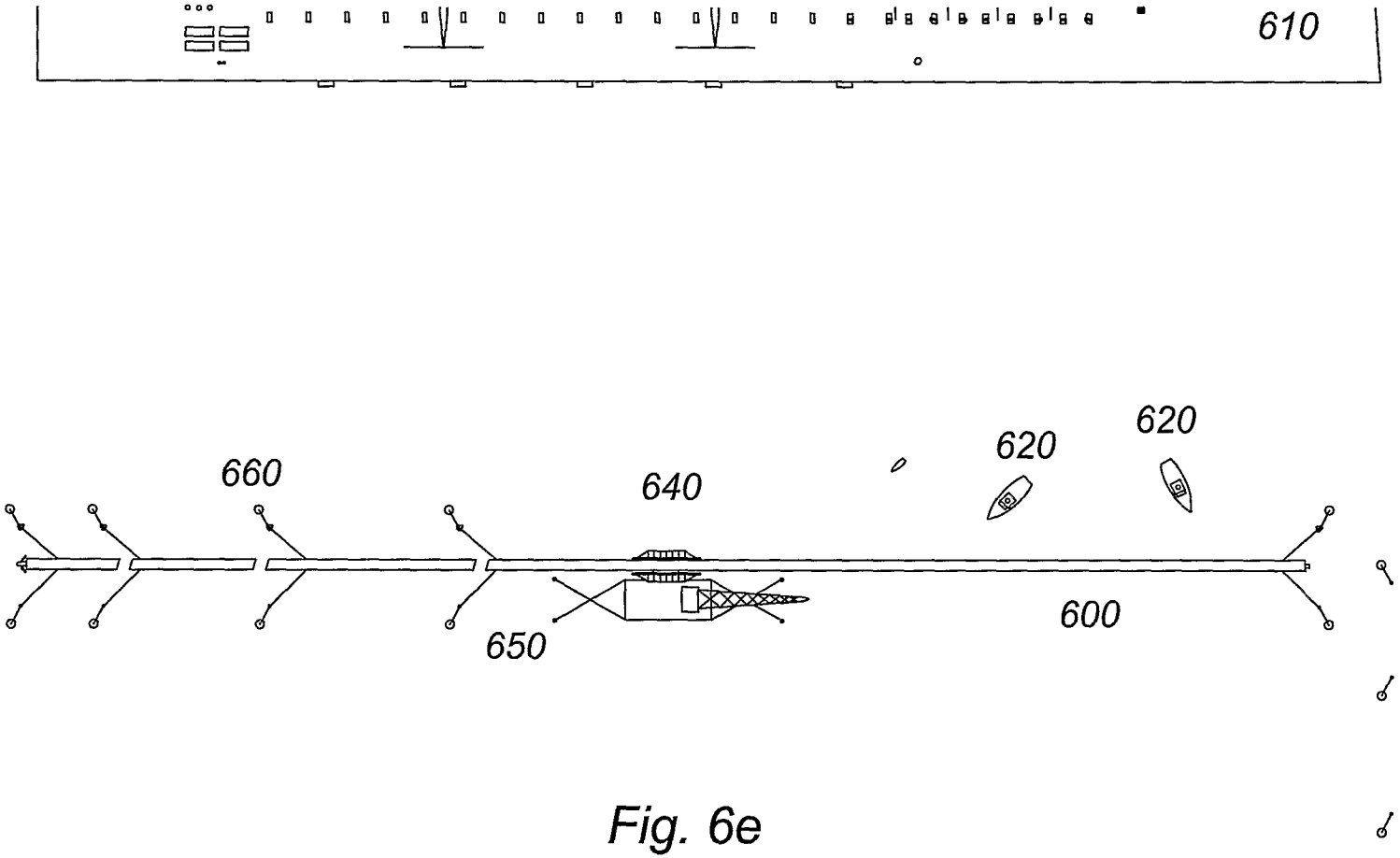

FIG. 6*e* shows the final section being attached, the complete riser bundle 660 extending out from the cofferdam 640, ready for installation, where it will be upended and sunk, with one end attached to an anchor on the seabed, the other end tensioned by a top buoy.

The above embodiments are for illustration only and other embodiments and variations are possible and envisaged without departing from the spirit and scope of the invention. For example, the riser arrangements depicted are simply for illustration and may be varied, including provision of less or more conduits than shown.

The invention claimed is:

1. A method of fabricating and installing a riser tower structure of the type comprising a plurality of elongate elements extending from the sea bed toward the sea surface, said method comprising:

fabricating sections of said riser tower structure by arranging said plurality of elongate conduits around a central core pipe to form said structure, said fabrication occurring at a site remote from the site of installation;

transporting the sections of said riser tower structure to within the vicinity of the installation site; and assembling together the sections of said riser tower structure in the vicinity of said installation site, wherein said assembly step comprises initially bringing together and attaching the central core pipe of each of two sections of riser tower structure to be connected, before bringing together and attaching the elongate conduits.

2. A method as claimed in claim 1, wherein the sections of said riser tower structure are assembled together in a welding chamber, or cofferdam.

3. A method as claimed in claim 2 wherein said welding chamber comprises a dry welding area.

4. A method as claimed in claim 2 wherein each of the elongate elements is introduced into said welding chamber via a corresponding guide means.

5. A method as claimed in claim 4 wherein two groups of such guide means are provided, each group on opposite sides of said welding chamber.

6. A method as claimed in claim 5 wherein the act of introducing each elongate elements into a corresponding guide means provides a watertight seal into said welding chamber.

7. A method as claimed in claim 5 comprising the initial steps of selecting the groups of guide means so as to correspond with the riser tower structure's cross sectional dimensions, and installing these on the welding chamber.

8. A method as claimed in claim 5 wherein each of said groups of guide means is provided on a door of said welding chamber.

9. A method as claimed in claim 4 wherein said fabrication step comprises the provision of at least one guiding frame on each section of riser structure, and the assembly step comprises the attachment of said guiding frame to holding means provided on the welding chamber so as to hold the riser structure such that each elongate element is in alignment with its corresponding guide means.

10. A method as claimed in claim 2 wherein said assembly of sections of riser tower structure is undertaken with said welding chamber floating on the sea surface.

11. A method as claimed in claim 2 including selectively ballasting the welding chamber appropriately.

12. A method as claimed in claim 2 wherein an alignment frame is used for fine alignment of two sections to be connected.

13. A method as claimed in claim 12 wherein said alignment frame is introduced into said welding chamber from above.

14. A method as claimed in claim 2 wherein a second welding chamber is used to increase the assembly speed.

15. A method as claimed in claim 1 wherein said riser tower structure is of the type designed to be held substantially vertical, as a result of a buoyancy force applied to its top, while its bottom is anchored to the sea bed.

16. A method as claimed in claim 1 wherein fabrication of each section of riser tower structure is performed in any fabrication yard, floating dock or dry dock at any suitable site.

17. A method as claimed in claim 1 wherein said riser tower structure sections are transported by sea on any suitable vessel including heavy lift vessel, a cargo barge or a semi submersible heavy transport vessel.

18. A method as claimed in claim 1 wherein each section of riser tower structure is greater than 100 meters long.

19. A method as claimed in claim 18, wherein each section of riser tower structure lies between 100 meters and 300 meters.

20. A method as claimed in claim 18 wherein each section of riser tower structure lies between approximately 150 and 200 meters.

* * * * *